US011135480B2

(12) United States Patent
Maresh

(10) Patent No.: US 11,135,480 B2
(45) **Date of Patent: *Oct. 5, 2021**

(54) SWIM FIN

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/736,798

(22) Filed: Jan. 7, 2020

(65) Prior Publication Data

US 2021/0052945 A1 Feb. 25, 2021

Related U.S. Application Data

(63) Continuation-in-part of application No. 16/125,696, filed on Sep. 8, 2018, now Pat. No. 10,525,307, which is a continuation of application No. 15/609,004, filed on May 30, 2017, now Pat. No. 10,071,288.

(60) Provisional application No. 62/973,771, filed on Oct. 24, 2019.

(51) Int. Cl.
*A63B 31/11* (2006.01)

(52) U.S. Cl.
CPC ..... *A63B 31/11* (2013.01); *A63B 2031/115* (2013.01); *A63B 2209/02* (2013.01); *A63B 2244/20* (2013.01)

(58) Field of Classification Search
CPC ..... A63B 31/11; A63B 2031/115; A63B 2209/02; A63B 2244/20
See application file for complete search history.

(56) References Cited

U.S. PATENT DOCUMENTS

| | | | | |
|---|---|---|---|---|
| 8,641,464 | B2 * | 2/2014 | Ortwig | A43B 5/18 441/64 |
| 9,764,192 | B1 * | 9/2017 | Maresh | A63B 31/11 |
| 10,071,288 | B1 * | 9/2018 | Maresh | A63B 31/11 |
| 10,525,307 | B1 * | 1/2020 | Maresh | A63B 31/11 |
| 2001/0044246 | A1 * | 11/2001 | McCarthy | C21D 7/04 441/64 |
| 2010/0273371 | A1 * | 10/2010 | Hsu | A63B 31/11 441/64 |

* cited by examiner

*Primary Examiner* — Stephen P Avila
(74) *Attorney, Agent, or Firm* — Nick A Nichols, Jr.

(57) ABSTRACT

A swim fin may include a foot pocket configured to receive a foot of a swimmer and a fin blade extending from the foot pocket. A relatively rigid substrate chassis may be bonded to the foot pocket. The fin blade may be relatively flexible. Fin rails may extend along the lateral edges of the fin blade. The fin rails may include a fin spine comprising a plurality of fin spine segments in linear configuration. The fin spine may be configured to provide a swim fin with predetermined hydrodynamic characteristics. The swim fin may flex within a maximum angle of attack that may be variable and dynamically changed, within a predetermined maximum attack angle range, as a function of the kicking force generated by a swimmer during a kicking cycle.

19 Claims, 7 Drawing Sheets

SWIM FIN

CROSS-REFERENCE TO RELATED APPLICATION

This application claims priority to and the benefit of the filing date of U.S. Provisional Application Ser. No. 62/973,771, filed Oct. 24, 2019, and is a continuation-in-part of U.S. patent application Ser. No. 16/125,696, filed Sep. 9, 2018, U.S. Pat. No. 10,525,307, which is continuation of U.S. patent application Ser. No. 15/609,004, filed May 30, 2017, U.S. Pat. No. 10,071,288, which applications are herein incorporated by reference in their entirety.

BACKGROUND

The present invention relates to hydrofoils of the type which are used for propulsion in a fluid medium, and more specifically to a swim fin which comprises a propulsion blade affixed to a foot pocket, and where the user is propelled forward while directing water behind the user while typically executing a flutter, frog, scissors, side, or dolphin kick.

A need has existed for a swim fin that will perform optimally during both low thrust and high thrust situations. Such a swim fin may be highly flexible and provide an optimum angle of attack during low kicking frequencies and low thrust situations, and yet during high kicking frequencies and high thrust situations the swim fin would tend to perform similar to a relatively stiff swim fin. Such a swim fin may also provide a smooth curved blade flex profile resulting in laminar water flow over the swim fin.

The prior art is replete with various fin designs which combine a foot pocket with side rails and a propulsion blade, with the objective being to provide maximum propulsion and agility while minimizing the work expended by the user. It is desirable to provide for an optimum angle of attack of the fin blade during the forward flutter kicking power stroke, while generally allowing the fin blade to yield to the water streamline during the return stroke. Prior art designs are typically either too rigid or too flexible for a given use, or have contours or profiles which result in inefficient hydrodynamics where the angle of attack is poor and/or water spills over the side of the blade or foil, and where such designs result in fluid vortices and/or turbulent flow which negates lift or propulsive forces resulting in a decrease in finning efficiency with a corresponding increase in fatigue. During scuba diving, propulsion efficiency is important in order to extend bottom time and minimize the expenditure of energy and consumption of air while moving through the water with less fatigue on the legs.

The variable known as "angle of attack" is defined as the relative angle that exists between the actual alignment of the oncoming flow or direction of motion of the swimmer and the lengthwise alignment of the fin blade. A correct angle of attack optimizes the conversion of kicking energy of the swimmer while providing thrust or propulsion through the water. An optimum blade angle of attack is desired during both rapid as well as slow kicking frequencies, and in general prior art fins do not achieve an optimum angle of attack at both extremes of kicking effort. These two distinct and opposite modes of operation traditionally require different fin durometers for a given angle of attack due to different bending force requirements of the fin blade or fin rails during the two different modes of operation.

The present invention provides for a swim fin with an optimum fin blade angle of attack during slow non-aggressive kicking, while at the same time during aggressive high kicking frequency and high thrust operation the angle of attack of the fin blade may be limited by articulating fin spines to ensure efficient operation with maximum laminar flow. The swim fin may be molded from a highly flexible low durometer material which cooperates with the articulated fin spines to prevent a high angle of attack from occurring where the bending radius of the fin blade is not allowed to collapse and fold or "go flat" beyond a given predetermined flex angle. This results in a highly flexibly swim fin during low and moderate exertion such that the user's ankle, foot, and the achilles tendon is not stressed, and yet if the user is more demanding the blade angle of attack may be rigidly enforced. Additionally, the high swim fin flex potential with predetermined maximum blade attack angles allows the user to change direction rapidly, particularly when agility is required as when the user must contort as needed during critical water diving or swimming events.

Furthermore, an additional benefit of the present invention is that torsional stiffness of the fin is generally balanced at left and right sides of the blade due to the bending limit constraints imposed on the fin rails by the articulating spines, and efficiency may thereby be gained by essentially eliminating the swim fin twist as the user kicks. In this manner proper flow over the fin blade surface without spilling power sideways may be generally achieved and the swim fin may track straighter without unwanted twisting and steering of the user, thus wasting energy. The result is a highly stabilized and straight-line kicking experience, while enabling maneuvering as desired.

SUMMARY

A swim fin may include a foot pocket configured to receive a foot of a swimmer and a fin blade extending from the foot pocket. A relatively rigid substrate chassis may be bonded to the foot pocket. The fin blade may be relatively. Fin rails may extend along the lateral edges of the fin blade. The fin rails may include a fin spine comprising a plurality of fin spine segments in linear configuration. The fin spine may be configured to provide a swim fin with predetermined hydrodynamic characteristics. The swim fin may flex within a maximum angle of attack that may be variable and dynamically changed, within a predetermined maximum attack angle range, as a function of the kicking force generated by a swimmer during a kicking cycle.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
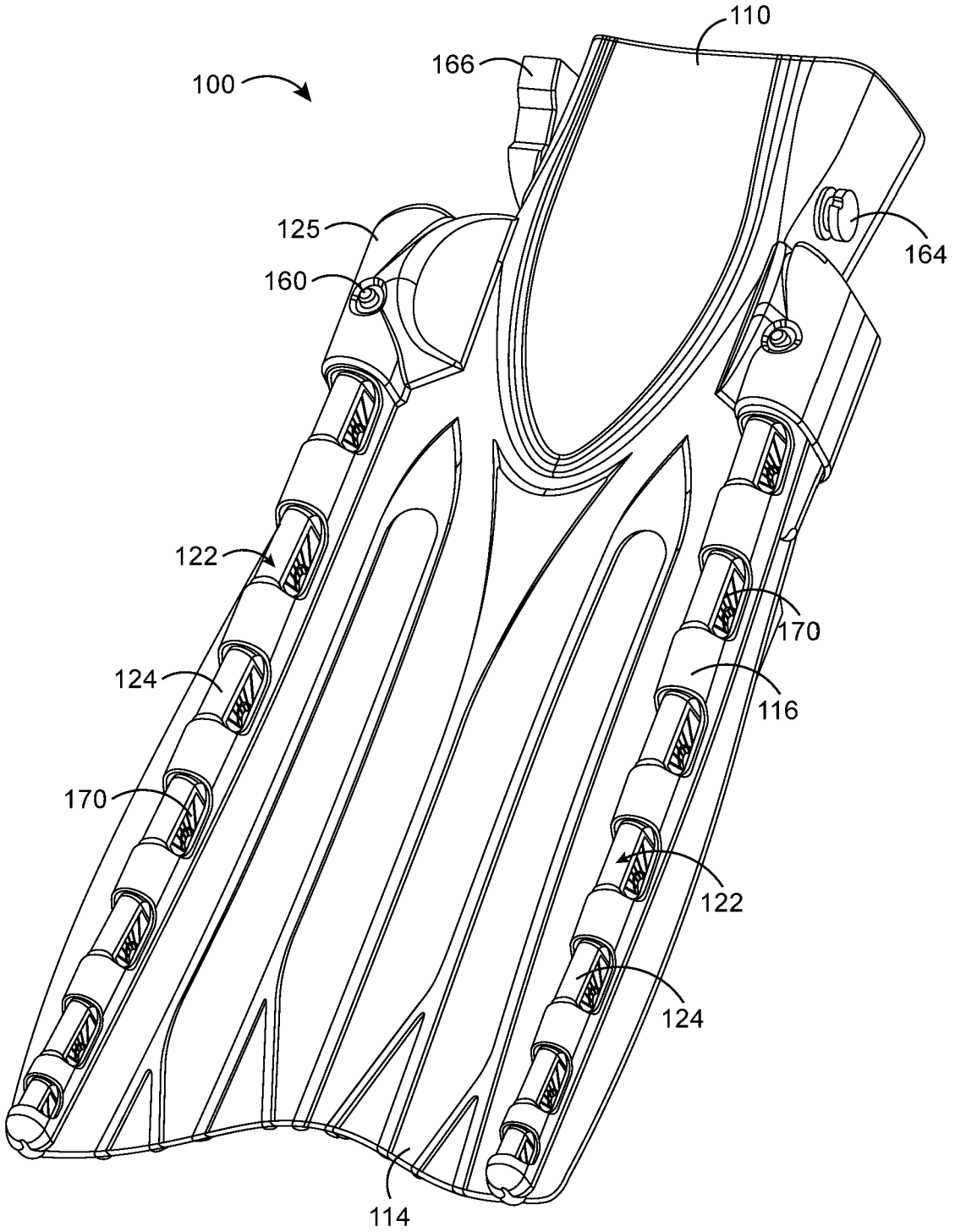
FIG. 1 is a perspective view of a swim fin.

Referring first to FIG. 1, a swim fin is generally identified by the reference numeral 100. The swim fin 100 may include a full boot or shoe or an open foot pocket 110, shown in FIG. 1, for receiving the foot of a swimmer. A heel strap may be provided to secure the foot of a swimmer in the foot pocket HO. A fin blade 114 may extend from the foot pocket HO. The fin blade 114 may include a substantially planar surface for channeling water flow across the swim fin 100. Fin rails 116 may extend along the lateral edges of the fin blade 114. The foot pocket 110 may include a vented region 118 to minimize parachuting while moving through the water and also to minimize suction while removing the user's foot from the foot pocket 110.

Figure 3:
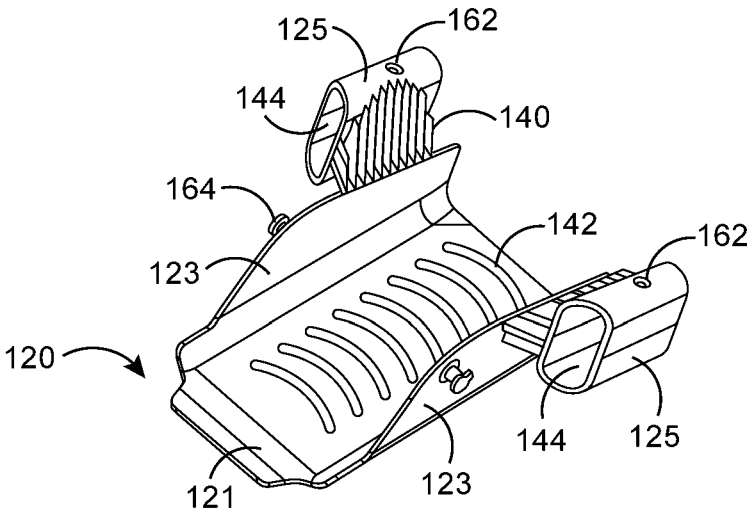
FIG. 3 is a perspective view of a substrate chassis component of the swim fin shown in FIG. 1.

Referring now to FIG. 3, the swim fin 100 may include a relatively rigid substrate chassis 120 which may be bonded to the foot pocket HO during an injection molding process. The chassis 120 may be constructed of stronger or stiffer material, such as but not limited to, nylon, Delrin, polyethylene, polycarbonate, polypropylene or other polymer, as compared to the relatively flexible fin blade 114, which may be constructed of materials, such as but not limited to, rubber, monoprene, santoprene, thermoplastic rubber and/or other synthetic material, and/or a composite of materials including carbon fiber. During the injection molding process, the chassis 120 may be inserted into the molding tool, and the flexible fin blade 114 and foot pocket 110 over molded in a manner known in the art. In the event the swim fin 100 is generally constructed of natural rubber or other material that does not lend itself to injection molding, the chassis 120 may be inserted into the compression cavity prior to the formation of the swim fin 100 during compression molding.

Figure 5:
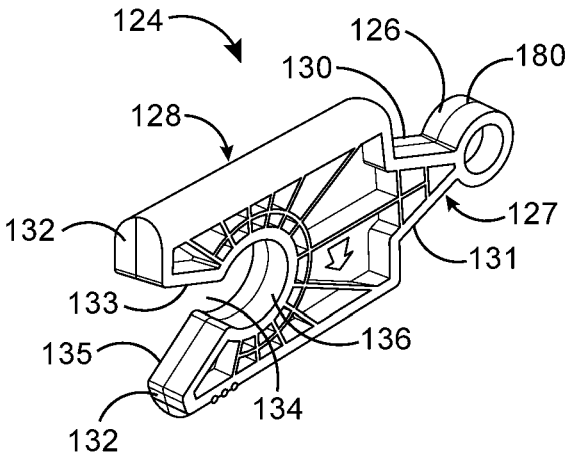
FIG. 5 is a perspective view of a fin spine segment of the swim fin shown in FIG. 1.

Referring again to FIG. 1, a fin spine 122 may be disposed in each of the fin rails 116. The fin spines 122 may comprise a plurality of articulated fin spine segments 124 in serial or linear configuration. Each fin segment 124 may be generally described as including a head 126, a neck portion 127 and a socket portion 128, best shown in FIG. 5. The neck portion 127 may include oppositely facing planar surfaces 130 and 131 extending from the head 126 to the socket portion 128.

The socket portion 128 of each fin spine segment 124 may include a pair of spaced apart prongs 132 defining a gap 134 therebetween opening into a cavity 136. The prongs 132 may include planar surfaces 133 and 135 facing one another. The cavity 136 may be sized and configured for cooperative engagement with the head 126 of a spine segment 124 to form a connection joint 138 between adjacent fin spine segments 124. The fin spine 122 may be assembled to a predetermined length and spine articulation. The interaction of the fin spine segments 124 contribute to the overall articulation of the fin spine 122. The fin spines 122 may be tapered down toward the distal ends thereof.

Figure 6A:
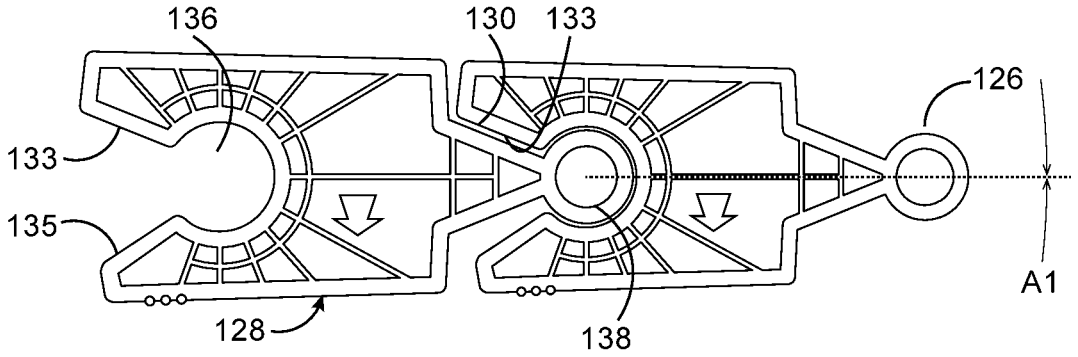
FIG. 6A is a side view illustrating the connection joint between fin spine segments of the swim fin shown in FIG. 1 where the fin spine is in a straight-line orientation.
Figure 6B:
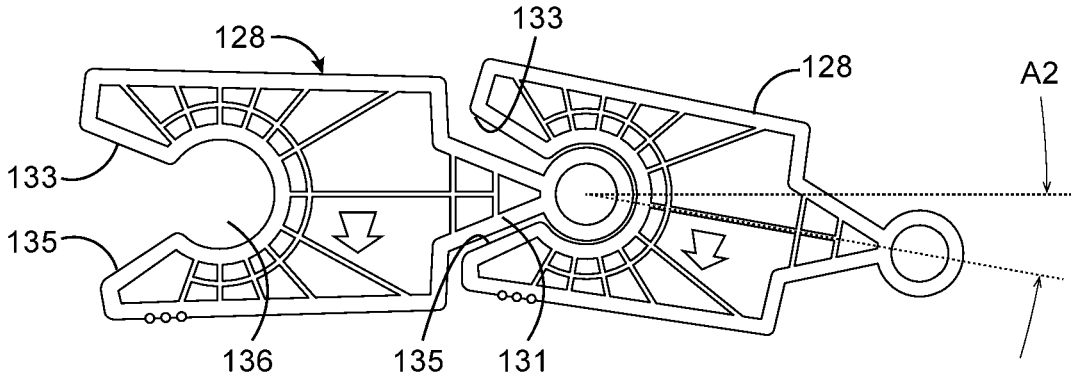
FIG. 6B is a side view illustrating the connection joint between fin spine segments of the swim fin shown in FIG. 1 where the fin spine is in an articulated orientation.
Figure 7A:
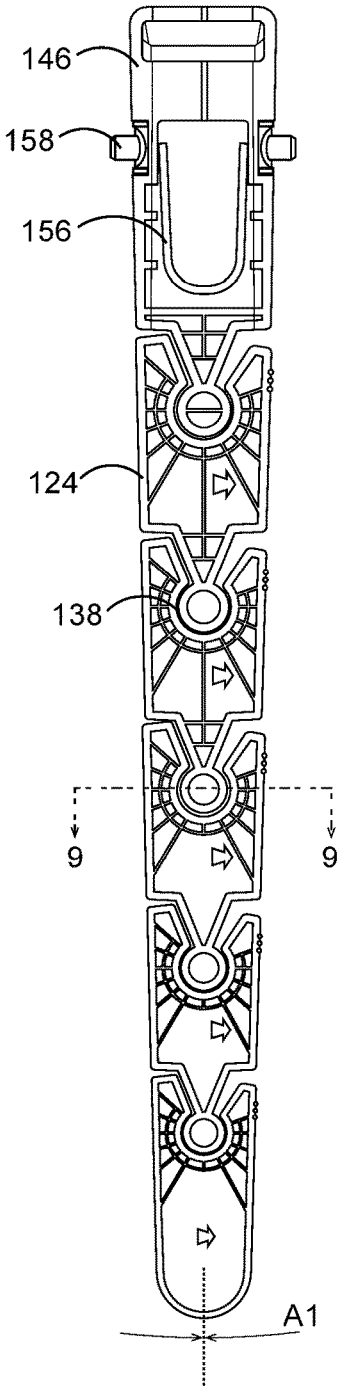
FIG. 7A is a side view of a fin spine of the swim fin shown in FIG. 1 illustrating the fin spine in a straight-line orientation.
Figure 7B:
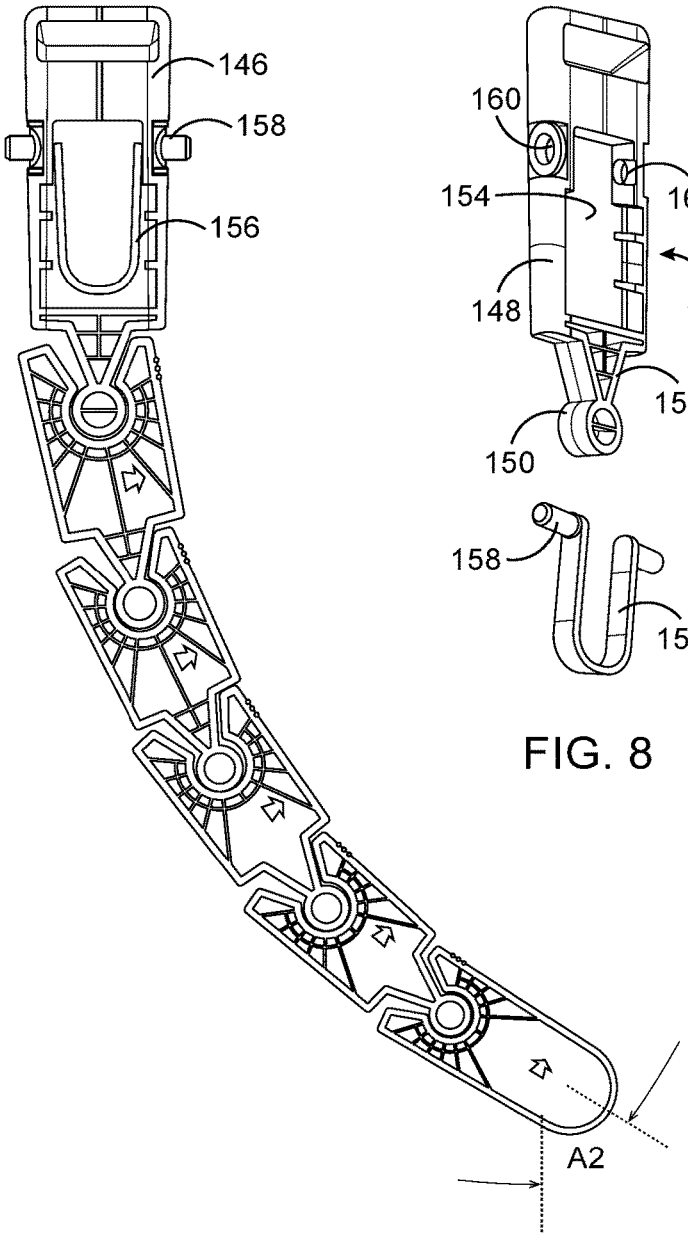
FIG. 7B is a side view of a fin spine of the swim fin shown in FIG. 1 illustrating the fin spine in an articulated orientation.

Articulation at each connection joint 138 may be limited by collision between the planar surfaces 130 of the neck portion 127 with planar surfaces 133 of the prongs 132 in a first articulation direction. Articulation in a second direction may be limited by collision between the planar surfaces 131 of the neck portions 127 with the planar surfaces 135 of the prongs 132. For example, the planar surfaces 130 and 133 of adjacent fin spine segments 124 collide in a first articulation direction when the overall spine articulation angle A1 is zero degrees (0°) or in the 'toe up' direction and the fin spine 122 is longitudinally straight, illustrated in FIG. 6A. The planar surfaces 131 and 135 of the fin spine segments 124 collide when the fin spine 122 articulates to an overall angle A2 of about sixty degrees (60°) in a second articulation direction or in the 'toe down' direction. In this particular example where the fin spine 122 includes five connection joints 138 between fin spine segments 124, the maximum pivot or rotation at each connection joint 138 is zero degrees (0°) in the 'toe up' A1 direction, and twelve degrees (12°) in the 'toe down' A2 direction. However, the maximum pivot range in either the 'toe up' or 'toe down' direction at any connection joint 138 does not have to be equal for all fin spines 122. Furthermore, the 'toe up' and 'toe down' allowable articulation angles A1 and A2, respectively, may be any acute angle less than ninety degrees (90°). For example, in some instances the 'toe up' overall articulation of the artificial spine may be about twenty-five degrees (25°).

Referring again to FIG. 3, the substrate chassis 120 may include a relatively flat bottom surface 121 and sidewalls 123. A fin spine connector 125 may be fixedly secured to each sidewall 123 of the substrate chassis 120 by rib members 140. The substrate chassis 120 may include a plurality of raised regions 142 and the like on the bottom surface 121 to minimize slippage of the user's foot while in the foot pocket 110.

Figure 8:
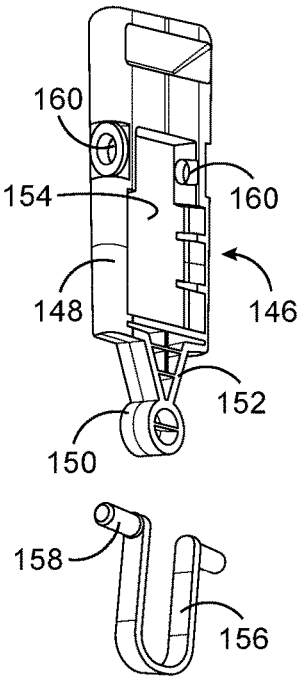
FIG. 8 is an exploded perspective view of a fin spine link of the swim fin shown in FIG. 1.

Each connector 125 may define a substantially tubular cavity 144 configured to receive a fin spine link 146 which connects the fin spines 122 to the substrate chassis 120. The fin spine link 146 may include an elongated body 148, best shown in FIG. 8. One end of the elongated body 148 may comprise a head 150 and neck portion 152 substantially similar to the head 126 and neck portion 127 of the fin spine segments 124 for pivotally connecting the fin spines 122 to the substrate chassis 120. The link 146 may include a hollow chamber 154 housing a leaf spring 156. Outwardly biased pins 158 may be located proximate the distal ends of the leaf spring 156. The pins 158 project through aligned openings 160 on opposite sides of the link 146. The fin spines 122 may be removably connected to the substrate chassis 120 by inserting the links 146 into respective fin spine connectors 125 and aligning the openings 160 of the fin spine links 146 with corresponding holes 162 in the fin spine connectors 125 so that the outwardly biased pins 158 extend through the holes 162. Heel strap posts 164 may be molded with the substrate chassis 120. The heel strap posts 164 provide connection points for heel strap connecting hardware 166 in a manner known in the art. The fin spines 122 may be removed upon pressing the pins 158 inwardly and retracting the fin spines 122 from the fin rails 116.

During fin kicking, the fin spines 122 generate a cantilevered bending moment transmitted to the substrate chassis 120 through the fin spine connectors 125 which is subsequently distributed throughout the foot pocket 110. The substrate chassis 120 supports the foot pocket 110 so that it does not substantially deform. Leaf regions may be provided along the top portion of the foot pocket 110 to minimize stiffness of the foot pocket 110 in the vicinity of the upper surface of the user's foot tarsometatarsal joint and/or metatarsals.

Figure 2:
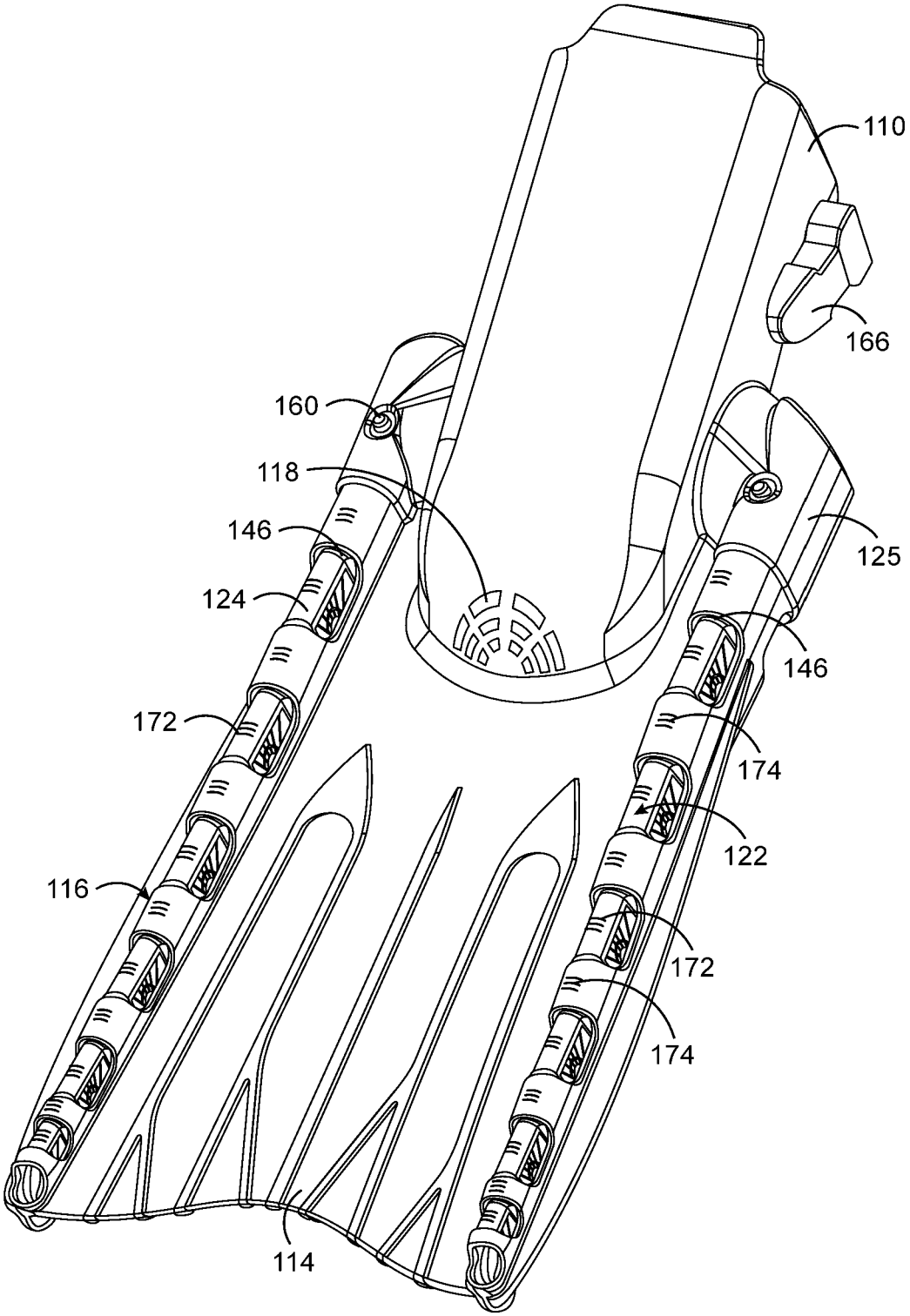
FIG. 2 is a bottom perspective view of the swim fin shown in FIG. 1.

Referring again to FIGS. 1 and 2, in one instance, the fin rails 116 may include a series of notched out portions or windows 170. The fin spine segments 124 may be provided with reference marks 172 which are visible and aligned with hash marks 174 on the fin rails 116 upon proper installation of the fin spines 122, particularly when the swim fin 100 is configured for asymmetrical bending of the fin spines 122.

Figure 4:
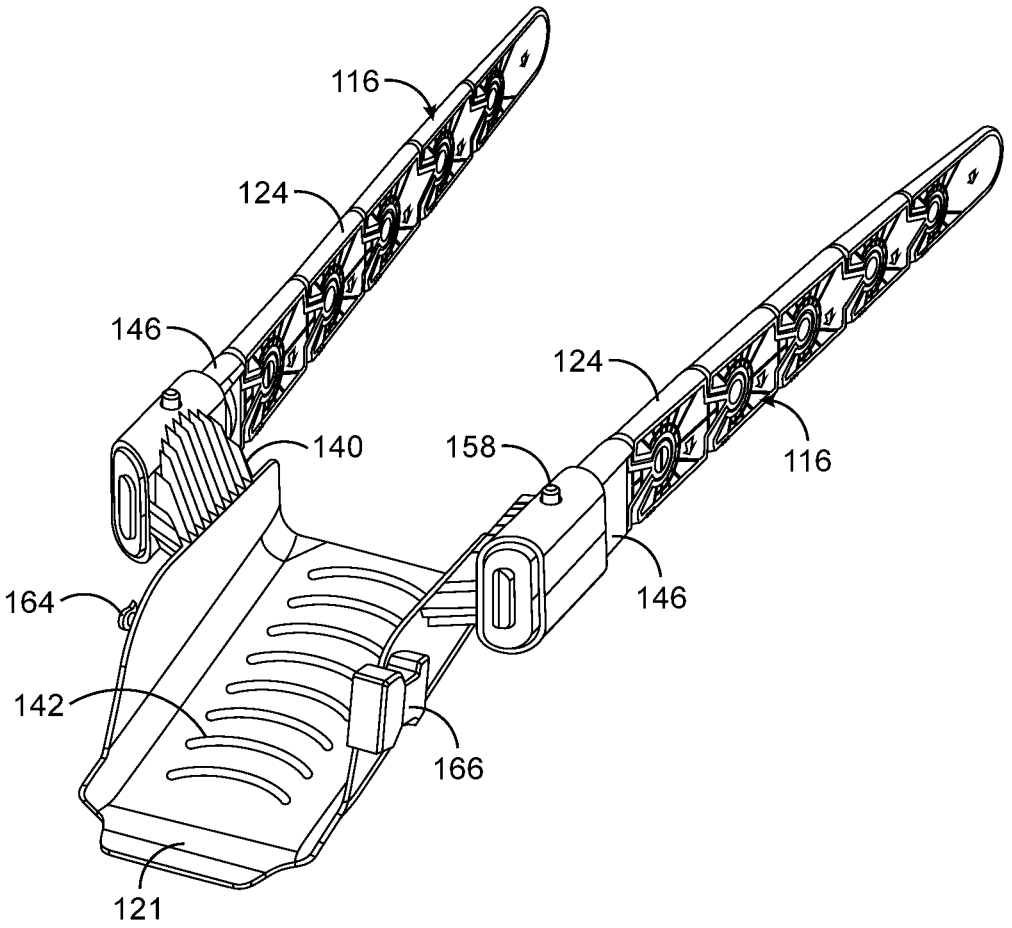
FIG. 4 is a perspective view of the substrate chassis and fin spines of the swim fin shown in FIG. 1.
Figure 9:
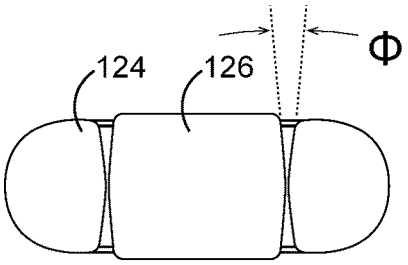
FIG. 9 is a section view taken along line 9-9 of FIG. 7A.

Three-dimensional fin blade scooping may improve efficiency and minimize water spilling over the fin rails 116 and may be provided by designing the injection molded draft angles of the fin spine segments 124 to be optimal with respect to the design blade 'angle of attack'. In this instance the reader will note that the fin spine segments 124 may have a draft angle $\phi$ (shown in FIG. 9) originating at the injection mold tooling parting line 180 (shown in FIG. 5) of typically one half of one degree. This minimum draft angle $\phi$ (from center out) required during the injection molding process of the fin spine segments 124 permits an effective lateral articulation of each fin spine 122 of approximately four degrees, which may be optimum for effective 3D blade scooping action, with the resulting dynamic scoop of fin blade 114 having a scoop radius of approximately six inches at the trailing edge of the fin blade 114. Further optimization of blade scooping may be achieved where the fin rails 116 are molded to diverge when the fin blade 114 is flat and at rest, and as a consequence the fin spines 122 laterally diverge at their distal ends, illustrated in FIG. 4. In such configuration, during kicking action the fin spines 122 converge at their distal ends when the opposed draft angles of the fin spine segments 124 laterally collide. Depending upon the size of the swim fin 100, different fin spine draft angles may be preferred in order to maximize efficiency without introducing a noticeable delay in reaction time for blade scooping inversions to occur during fin kicking reversals.

Figure 10B:
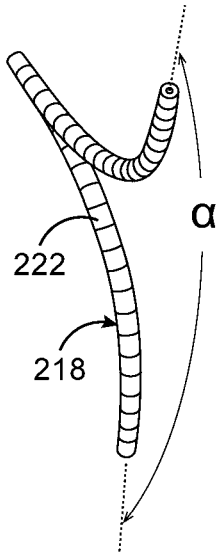
FIG. 10B is a partial perspective view of a fin spine of the swim fin shown in FIG. 10A, illustrating the fin spine in an articulated orientation.
Figure 10A:
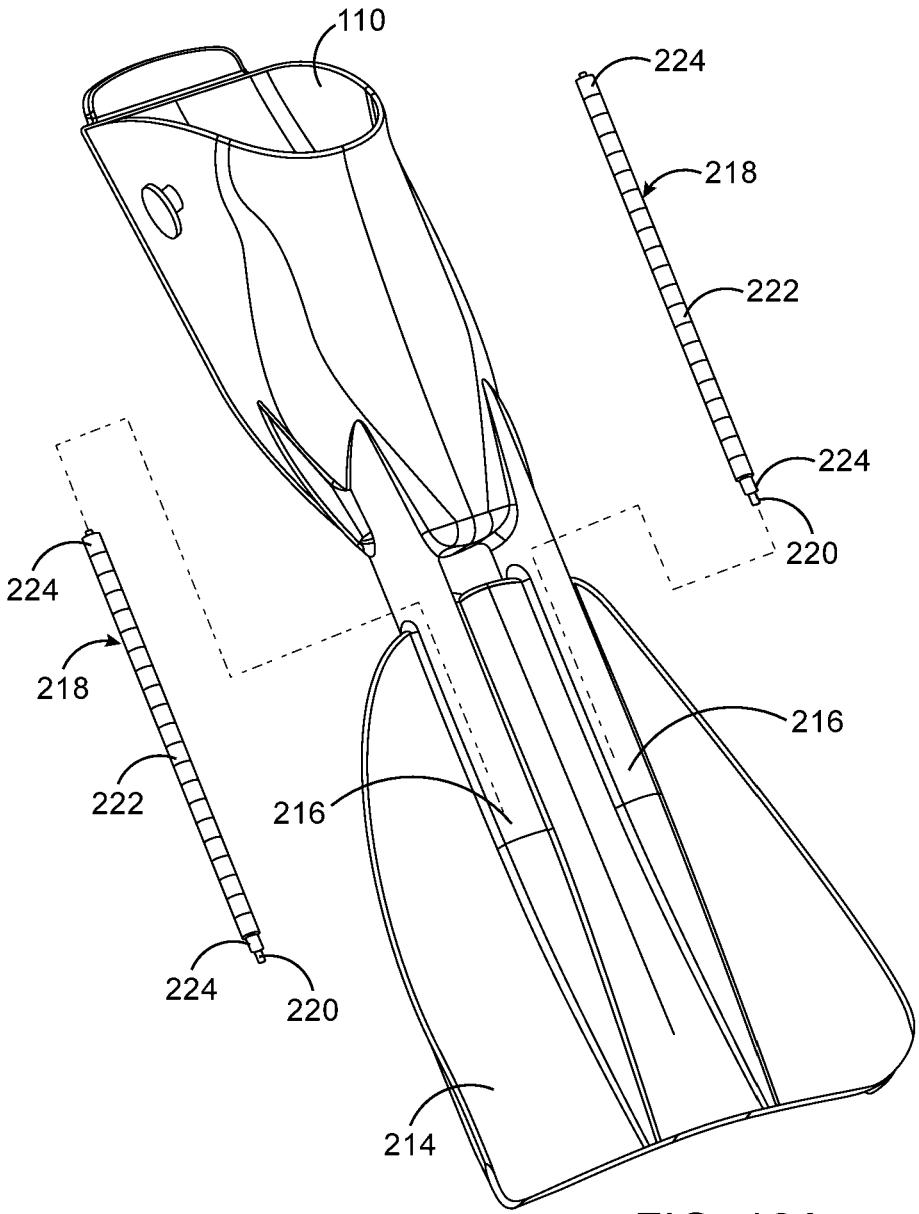
FIG. 10A is an exploded perspective view of a second embodiment of a swim fin.

Referring now to FIG. 10A and FIG. 10B, a second illustrative embodiment of a swim fin is generally identified by the reference numeral 200. As indicated by the use of common reference numerals, swim fin 200 is similar to the swim fin 100 described hereinabove. The swim fin 200 may include a full boot or shoe or an open foot pocket 110 for receiving the foot of a swimmer. A heel strap may be provided to secure the foot of a swimmer in the foot pocket 110. A fin blade 214 may extend from the foot pocket 110. The fin blade 214 may include a substantially planar surface for channeling water flow across the swim fin 200. Fin rails 216 may be disposed within lateral intermediate regions of the fin blade 114. The fin rails 216 may define longitudinal cavities configured to receive fin spines 218. The fin spines 218 may include a cable 220 and a plurality of fin spine segments 222 threaded on the cable 220. Fin spine segments 222 may be loosely captured between lugs 224 fixedly crimped at the distal ends of the cable 220. The fin spines 218 may flex through an angle $\alpha$, shown in FIG. 10B.

Figure 11:
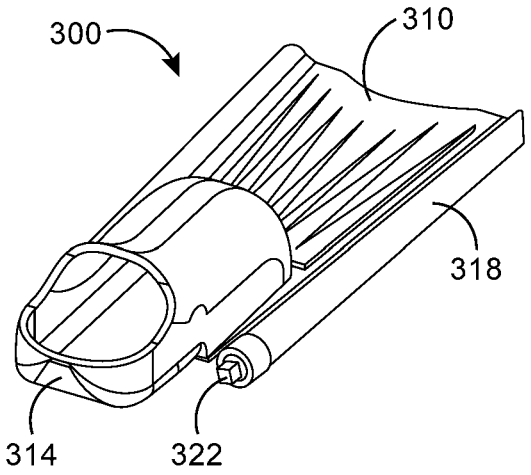
FIG. 11 is a perspective view of a third embodiment of a swim fin.
Figure 12:
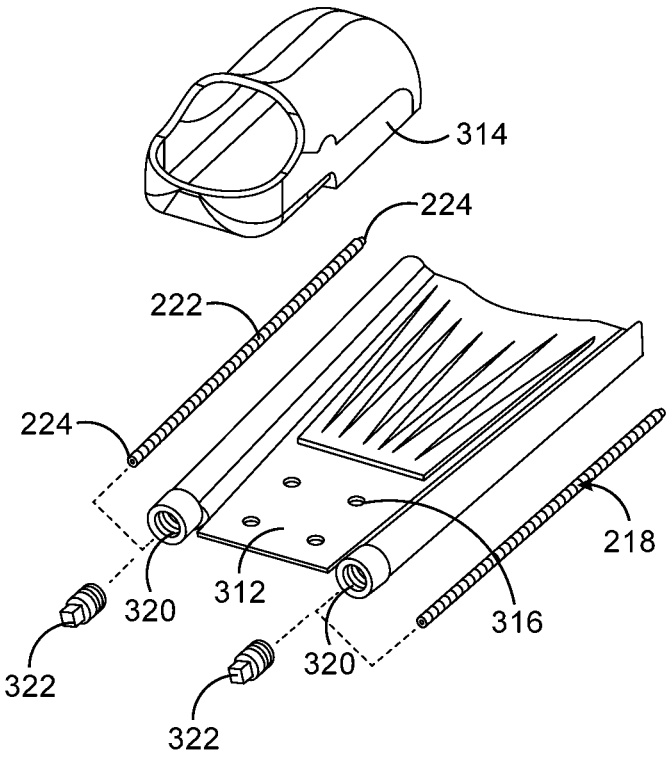
FIG. 12 is an exploded perspective view of the swim fin shown in FIG. 11.

Referring now to FIG. 11 and FIG. 12, a third illustrative embodiment of a swim fin is generally identified by the reference numeral 300. As indicated by the use of common reference numerals, swim fin 300 is similar to the swim fin 100 described hereinabove. The swim fin 300 may include a fin blade 310 constructed, for example but without limitation, of a thermoplastic such as a polyethylene. A chassis 312 may be integrated with the fin blade 310, without over molding. A foot boot 314 may be constructed of a soft low durometer material, such as but without limitation, rubber or monoprene. The foot boot 314 may be bonded directly to the fin blade 310. Irregular surfaces, holes 316 and the like may aid in bonding the foot boot 314 to the chassis 312. The fin blade 310 may include a substantially planar surface for channeling water flow across the swim fin 300. Fin rails 318 may extend along the lateral edges of the fin blade 310. The fin rails 318 may define longitudinal cavities 320 configured to receive fin spines 218. The fin spines 218 may include a cable 220 and a plurality of fin spine segments 222 threaded on the cable 220. Fin spine segments 222 may be captured between lugs 224 fixedly crimped at the distal ends of the cable 220. The longitudinal cavities may be partially filled with mineral oil, vegetable oil or other ecologically friendly fluid in order to minimize potential galvanic corrosion activity that may be present in saltwater. The fin spines 218 may be inserted in the longitudinal cavities 320 which may thereafter be sealed with plugs 322.

While preferred embodiments of the invention have been shown and described, other and further embodiments of the invention may be devised without departing from the basic scope thereof, and the scope thereof is determined by the claims which follow.

The invention claimed is:

1. A swim fin comprising:

a) a flexible body including a foot pocket adapted to receive a foot of a swimmer;

b) a flexible fin blade defining a substantially flat surface between laterally spaced edges;

c) said fin blade including fin rails extending along said laterally spaced edges defining longitudinal cavities;

d) fin spines adapted for receipt in respective said longitudinal cavities, wherein said fin spines comprise a plurality of fin spine segments in linear configuration; and e) a substrate chassis bonded to said foot pocket.

2. The swim fin of claim 1 wherein said plurality of fin spine segments include a head portion, a neck portion, and a socket portion, said neck portion including oppositely facing planar surfaces extending from said head portion to said socket portion.

3. The swim fin of claim 2 wherein said socket portion includes a pair of prongs in spaced apart relationship to one another defining a gap therebetween opening into a cavity of said socket portion.

4. The swim fin of claim 3 wherein said socket portion of said plurality of fin spine segments is configured for cooperative engagement with said head portion of an adjacent one of said plurality of fin spine segments.

5. The swim fin of claim 3 wherein said pair of prongs include planar surfaces in facing relationship to one another, said pair of prongs interengagable with said neck portion of an adjacent one of said plurality of fin spine segments limiting articulation of said fin spines.

6. The swim fin of claim 1 including fin spine connectors fixedly secured to said substrate chassis coupling said fin spines to said substrate chassis.

7. The swim fin of claim 1 including fin spine links removably connecting respective said fin spines to said substrate chassis.

8. The swim fin of claim 7 including a leaf spring housed in each said fin spine links.

9. The swim fin of claim 1 wherein said fin rails include a series of openings along the length of said fin rails.

10. The swim fin of claim 1 wherein each of said plurality of fin segments include draft angles permitting lateral articulation of said fin spine.

11. The swim fin of claim 1 wherein said fin rails include laterally diverging distal ends.

12. The swim fin of claim 1 wherein said plurality of fin segments are threaded on a cable captured between distal ends of said cable.

13. The swim fin of claim 12 including a plug member removably secured to seal an open end of said longitudinal cavities, and wherein said longitudinal cavities are at least partially filled with a liquid.

14. A swim fin comprising:

a) a fin body, said fin body including a fin blade having laterally spaced apart edges;

b) a foot pocket fixedly secured to said fin body;

c) said fin body including longitudinal channels in spaced apart relationship to one another;

d) articulating fin spines adapted for receipt in said longitudinal channels;

e) a substrate chassis fixedly secured to said fin body; and f) fin spine links interconnecting said fin spines to said substrate chassis.

15. The swim fin of claim 14 wherein said fin spines comprise a plurality of spine segments in linear configuration, said plurality of spine segments include a head, a neck portion, and a socket portion, said neck portion including oppositely facing planar surfaces extending from said head to said socket portion, said socket portion configured for cooperative engagement with said head of an adjacent one of said plurality of spine segments.

16. The swim fin of claim 15 wherein said plurality of spine segments are interengagable with an adjacent one of said plurality of spine segments.

17. The swim fin of claim 15 including fin spine connectors fixedly secured to said substrate chassis, said fin spine connectors configured for receipt of a respective said fin spine links.

18. The swim fin of claim 16 wherein each of said plurality of spine segments include draft angles permitting lateral articulation of said fin spines.

19. The swim fin of claim 17 wherein said fin spine links include an outwardly biased leaf spring coupling said fin spine links to said fin spine connectors.

* * * * *